US009520687B2

(12) United States Patent
Gao et al.

(10) Patent No.: US 9,520,687 B2
(45) Date of Patent: Dec. 13, 2016

(54) HIGH BANDWITH JACK WITH RJ45 BACKWARDS COMPATIBILITY HAVING AN IMPROVED STRUCTURE FOR REDUCING NOISE

(71) Applicant: FOXCONN INTERCONNECT TECHNOLOGY LIMITED, Grand Cayman (KY)

(72) Inventors: Sheng-Pin Gao, Kunshan (CN); Yong-Chun Xu, Kunshan (CN); Chih-Ching Hsu, New Taipei (CN); Hao Han, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/831,889

(22) Filed: Aug. 21, 2015

(65) Prior Publication Data

US 2016/0056596 A1 Feb. 25, 2016

(30) Foreign Application Priority Data

Aug. 21, 2014 (CN) ..... 2014 1 0412446
Aug. 21, 2014 (CN) ..... 2014 1 0412447
Aug. 21, 2014 (CN) ..... 2014 1 0419457

(51) Int. Cl.
*H01R 13/66* (2006.01)
*H01R 24/64* (2011.01)
(Continued)

(52) U.S. Cl.
CPC ..... *H01R 24/64* (2013.01); *H01F 27/24* (2013.01); *H01R 13/7193* (2013.01); *H01R 13/6658* (2013.01)

(58) Field of Classification Search
CPC ..... H01R 24/64; H01R 13/6658
See application file for complete search history.

(56) References Cited

U.S. PATENT DOCUMENTS 4,274,691 A 6/1981 Abernethy et al.
5,872,492 A 2/1999 Boutros
(Continued)

FOREIGN PATENT DOCUMENTS

CN 201708287 4/2010
CN 203787618 8/2014
(Continued)

*Primary Examiner* — Briggitte R Hammond
(74) *Attorney, Agent, or Firm* — Wei Te Chung; Ming Chieh Chang

(57) ABSTRACT

An electrical connector comprises a housing including a plug-receiving receptacle, a set of mating contacts each having a mating portion extending in the plug-receiving receptacle and a first connecting portion, a set of mounting contacts each having a second connecting portion, an insulative carrier having opposed front and rear walls and a receiving chamber, and a set of magnetic components each having a magnetic core received in the receiving chamber and a number of conductive wires winding therearound. The mating contacts are held by a bottom section of the front wall, and the mounting contacts are held by a bottom section of the rear wall. Each conductive wire has a first end connecting with the first connecting portion of the mating contact and an opposite second end connecting with the second connecting portion of the mounting contact. The electrical distance from the mating contacts to the mother board is reduced.

20 Claims, 7 Drawing Sheets

(51) Int. Cl.
*H01F 27/24* (2006.01)
*H01R 13/7193* (2011.01)

(56) References Cited

U.S. PATENT DOCUMENTS

| | | | | |
|---|---|---|---|---|
| 6,142,822 | A | 11/2000 | Wu | |
| 6,428,361 | B1 | 8/2002 | Imschweiler et al. | |
| 6,554,638 | B1 * | 4/2003 | Hess | H01R 13/7172 439/490 |
| 6,644,984 | B2 * | 11/2003 | Vista, Jr. | H01R 9/091 439/76.1 |
| 6,786,775 | B1 | 9/2004 | Hanrahan et al. | |
| 6,994,594 | B2 | 2/2006 | Milner et al. | |
| 7,153,158 | B1 * | 12/2006 | Lee | H01R 13/6658 439/541.5 |
| 7,267,584 | B1 * | 9/2007 | Liu | H01R 13/6658 439/676 |
| 7,485,004 | B2 * | 2/2009 | Liu | H01R 12/58 439/620.25 |
| 7,611,383 | B1 * | 11/2009 | Huang | H01R 13/6658 439/620.17 |
| 7,837,511 | B2 * | 11/2010 | Hsu | H01R 13/6658 439/490 |
| 8,113,882 | B1 * | 2/2012 | Chen | H01R 13/6581 439/607.01 |
| 8,460,036 | B1 * | 6/2013 | Chen | H01R 13/6474 439/660 |
| 8,512,082 | B1 | 8/2013 | Ku et al. | |
| 8,535,100 | B2 * | 9/2013 | Ge | H01R 13/6658 439/620.17 |
| 2004/0014362 | A1 * | 1/2004 | Slack | H01R 24/64 439/620.11 |
| 2004/0082223 | A1 * | 4/2004 | Hyland | H01R 13/6658 439/620.11 |
| 2007/0015416 | A1 * | 1/2007 | Gutierrez | H01R 24/64 439/676 |
| 2007/0270044 | A1 | 11/2007 | Belopolsky et al. | |
| 2009/0298340 | A1 | 12/2009 | Li | |
| 2012/0236851 | A1 | 9/2012 | Woodruff et al. | |
| 2013/0280962 | A1 | 10/2013 | Fransen | |
| 2014/0080360 | A1 | 3/2014 | Tai et al. | |
| 2014/0194009 | A1 * | 7/2014 | Zhang | H01R 13/514 439/676 |

FOREIGN PATENT DOCUMENTS

| | | |
|---|---|---|
| TW | 389391 | 5/2000 |
| TW | M412505 | 9/2011 |
| TW | M423952 | 3/2012 |
| TW | 201414116 A | 4/2014 |

* cited by examiner

HIGH BANDWITH JACK WITH RJ45 BACKWARDS COMPATIBILITY HAVING AN IMPROVED STRUCTURE FOR REDUCING NOISE

BACKGROUND OF THE INVENTION

1. Field of the Invention

The present invention relates to a high speed electrical connector, and more particularly to a structure for reducing noise and electromagnetic interference therein.

2. Description of Related Art

Data center network infrastructure is witnessing a transformation, driven by growing bandwidth and network-performance demand. 10 Gigabit Ethernet is the de-facto standard in todays' data center with growing adoption of 40 G While 40 G Ethernet standards already exist for single mode fiber and MPO-based multimode fiber cabling, standards bodies (IEEE 802.3bq) are currently developing 40 GBase-T Ethernet over twisted-pair copper cabling systems. In 2012 the Institute of Electrical and Electronics Engineers (IEEE) initiated a formal project for defining a 40 GBase-T standard using twisted-pair cabling. Such high networking speed imposes strict performance requirements for modular jack connecting cabling systems with PHY board.

Some companies advise to adopt ARJ45 or GG45 to replace traditional RJ45 structure for 40 Gbase-T. However, the ARJ45 is not backward compatible with RJ45, which is widely used in Ethernet routers and switches.

Traditional R45 has a long signal transmitting trace in the RJ45, therefore it does not meet noise and electromagnetic interference's requirements in 40 GBase-T Ethernet.

SUMMARY OF THE INVENTION

Accordingly, an object of the present invention is to provide a high speed electrical connector meeting strict noise and electromagnetic interference requirements.

In order to achieve the object set forth, the invention provides an electrical connector comprising an insulative housing including a plug-receiving receptacle, a set of mating contacts each having a mating portion extending in the plug-receiving receptacle and a first connecting portion extending along a top-to-bottom direction, a set of mounting contacts having a second connecting portion extending along the top-to-bottom direction, an insulative carrier having opposed front and rear walls and a receiving chamber, and a set of magnetic components each having a magnetic core received in the receiving chamber and a plurality of conductive wires winding therearound. The mating contacts held by a bottom section of the front wall, the mounting contacts held by a bottom section of the rear wall. Each conductive wire has a first end connecting with the first connecting portion of the mating contact and a second opposite end connecting with the second connecting portion of the mount contacts. The electrical distance from the mating contacts to the mother board is reduced so that noise and electromagnetic interference in the electrical connector also are reduced.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-7, an electrical connector 100 according to the present invention is shown. The electrical connector 100 could be mounted on a horizontal mother board 200 positioned PHY side. The electrical connector 100 also has a front receptacle for mating with a modular plug positioned cable side.

Figure 1:
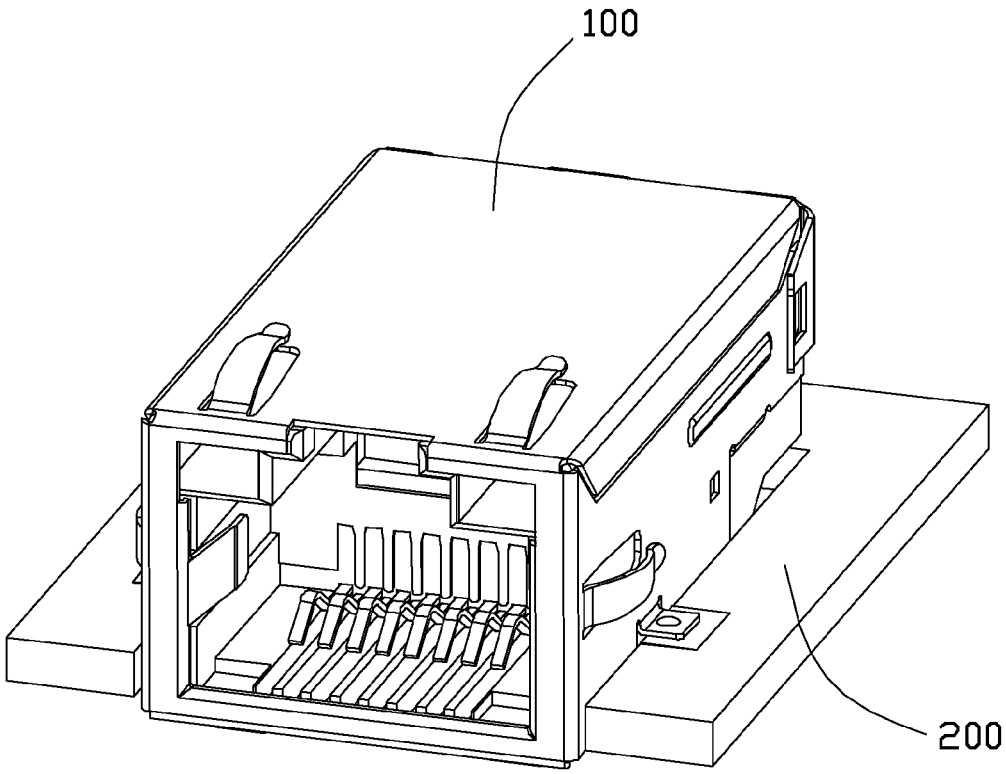
FIG. 1 is a perspective view of an electrical connector according to the present invention, and a horizontal mother board for the electrical connector mounting thereon.
Figure 2:
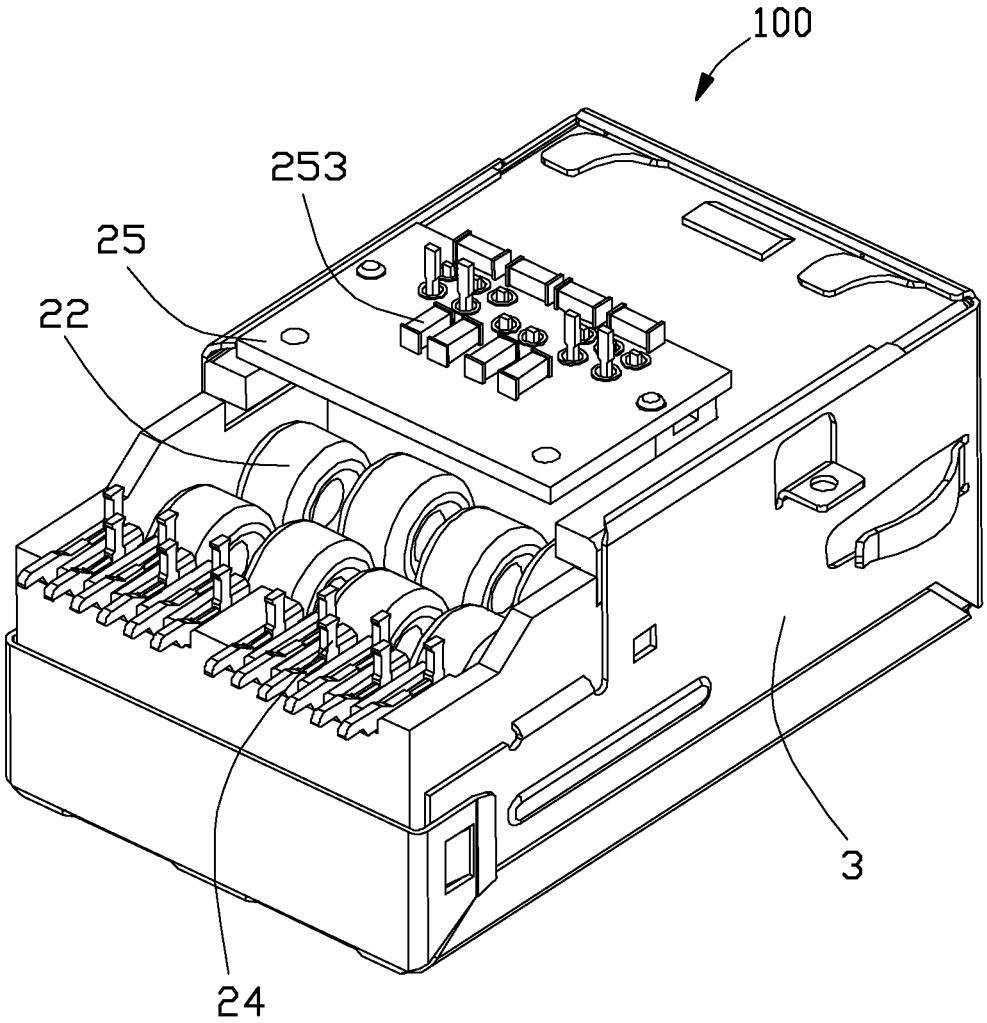
FIG. 2 is another perspective view of the electrical connector shown in FIG. 1.
Figure 3:
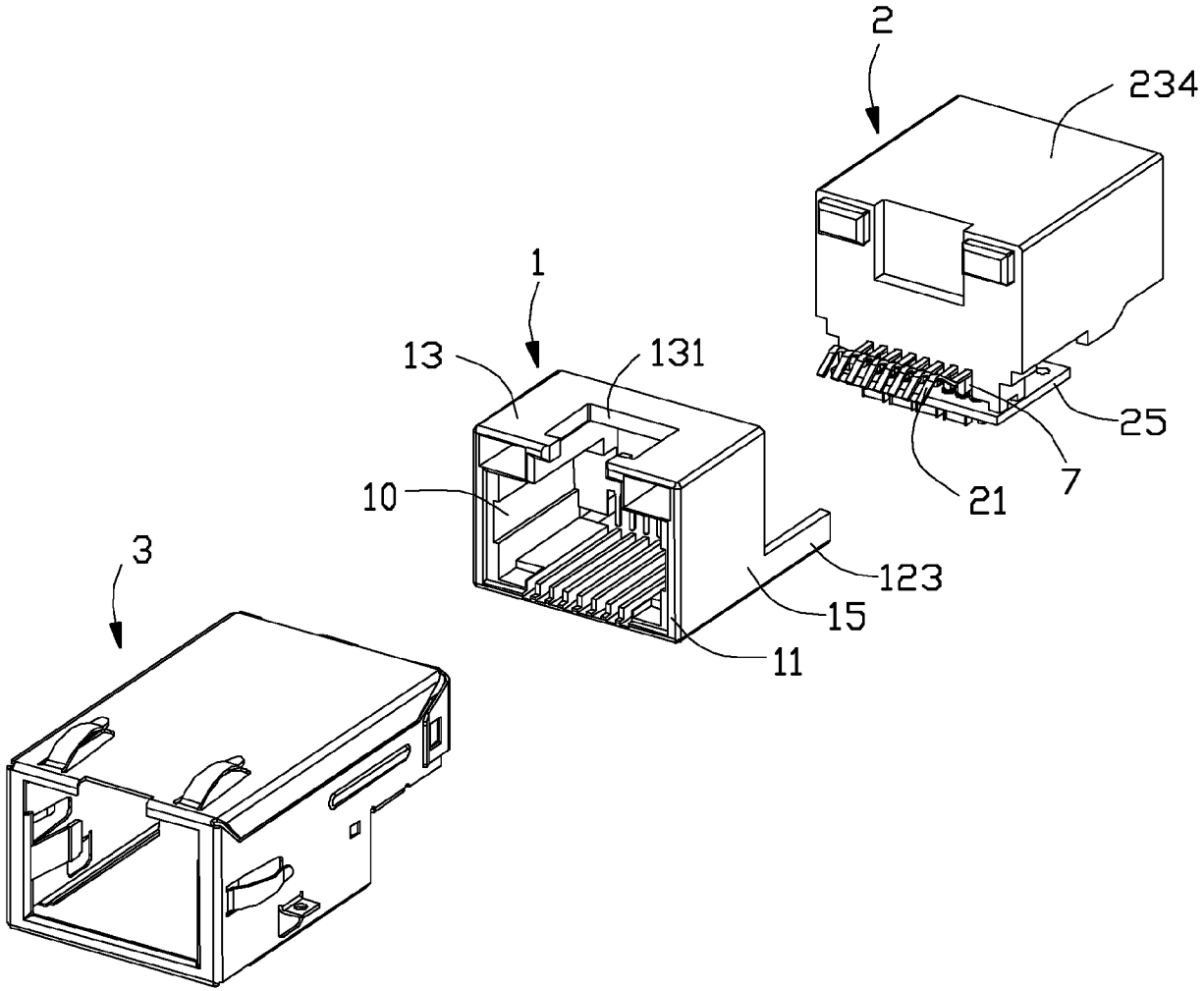
FIG. 3 is an exploded view of the electrical connector shown in FIG. 1.
Figure 4:
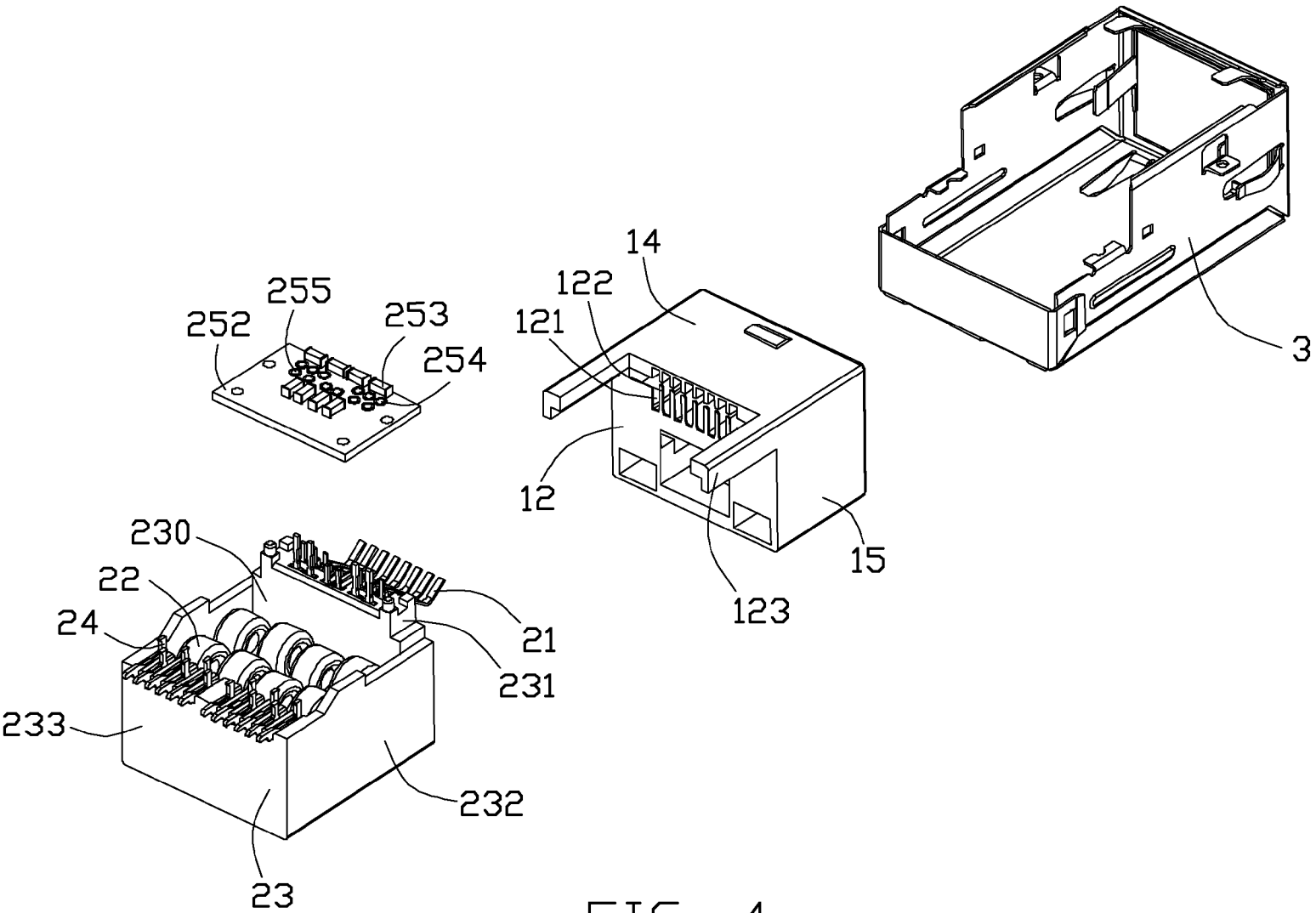
FIG. 4 is another exploded view of the electrical connector shown in FIG. 1.

Referring to FIG. 3, the electrical connector 100 includes an insulative housing 1, a contact module 2, and a metal shield shell 3 enclosing the insulative housing 1 and the contact module 2.

The insulative housing 1 includes a front wall 11, a rear wall 12, a top wall 13, a bottom wall 14, and two side walls 15. The insulative housing 1 defines a plug-receiving receptacle 10 for a modular plug inserting therein. The plug receiving receptacle 10 is recessed backwardly from a front face of the front wall 11. The top wall 13 defines a locking slot 131 extending therethrough to communicate with the plug-receiving receptacle 10. The locking slot 131 is used to lock with a tail of the modular plug. The rear wall 12 has a row of spacing grooves 121 and a row of spacing ribs 122 each located between two adjacent spacing ribs 122. The spacing grooves 121 communicate with the plug-receiving receptacle 10 along a back-to-front direction. The insulative housing 1 also has a pair of guiding posts 123 extending from two bottom corners of the rear wall 12. The guiding posts 123 are used for the contact module 2 easily sliding and assembling to the insulative housing 1.

The contact module 2 includes a set of mating contacts 21, a set of mounting contacts 24, a set of magnetic components 22 electrically connecting therebetween, an insulative carrier 23 receiving the magnetic components 22, and a horizontal PCB 25 assembled to the insulative carrier 23 along a bottom-to-top direction. The PCB 25 has an upper face near to the insulative carrier 23 and a lower face 252 far away from the insulative carrier 23. The lower face 252 has a plurality of capacitors 253 mounted thereon and each capacitor 253 electrically connecting between two mating contacts 21 for compensating crosstalk therebetween. The PCB 25 defines a row of first conductive holes 254 and a row of second holes 255 located behind the first conductive holes 254. The conductive holes 254, 255 extend through the PCB 25 along a top-to-bottom direction.

The insulative carrier 23 includes a front wall 231, a rear wall 233, two opposed side wall 232, and a top wall 234. The front, real; top, and side walls integrally formed and defining a receiving chamber 230 opening downwardly to receive the magnetic components 22. The mating contacts 21 are held by a bottom section of the front wall 231, and the mounting contacts 24 are held by a bottom section of the rear wall 233.

The insulative carrier 23 defines a set of holding slots 7 located at a bottom section of the front wall 231 and a set of holding grooves 235 located at a bottom section of the rear wall 233. The holding slots 7 extend through a front face and a bottom face of the front wall 231. The holding grooves 235 extend through a front face, a rear face, and a bottom face of the rear wall 233.

The mating contacts 21 include a first contact 211, a second contact 212, a third contact 213, a fourth contact 214, a fifth contact 215, a sixth contact 216, a seventh contact 217, and a eighth contact 218 arranged side by side. Each pair of the first and second contacts 211, 212, the third and sixth contact 213, 216, the fourth and fifth contact 214, 215, the seventh and eighth contact 217, 218 form a differential signal pair. The capacitors 253 include one capacitor electrically connecting between the first and third contacts 211, 213, one capacitor electrically connecting between the third and the fifth contacts 213, 215, one capacitor electrically connecting between the fourth and sixth contacts 214, 216, and one capacitor electrically connecting between the sixth and eighth contacts 216, 218. The electrical connector 100 with the capacitors 253 has a better performance of differential near end crosstalk than that of the electrical connector without the capacitors, under the 40 Gbps Base-T Ethernet signal transmitting test conditions.

The mating contacts 21 extend upwardly from the PCB 25 and then extend forwardly into the plug-receiving receptacle 10. Each mating contact 21 includes a connecting portion 81 extending along the top-bottom direction, a horizontal portion 83 extending perpendicular to the connecting portion 81, and a mating portion 85 extending forwardly from the horizontal portion 83. The connecting portions 81 of the fourth contact 214 and the fifth contact 215 are arranged in a row, and the connecting portions 82 of the third contact 213 and the sixth contact 216 are arranged in another row. The crosstalk between the third, sixth, fourth, and fifth contacts are bigger than other contact pairs. The connecting portions 81 of the third, sixth, fourth, and fifth contacts are arranged in a staggered fashion to reduce the crosstalk therebetween. The connecting portions 81 of the third and sixth contacts 213, 216 are inserted into two corresponding first conductive holes 254, the connecting portions 81 of the fourth and fifth contacts 214, 215 are inserted into two corresponding second conductive holes 255. The first, second, seventh, eighth contacts 211, 212, 217, 218 could be inserted into corresponding first conductive holes 254.

The holding slots 7 includes a first slot 71, a second slot 72, a third slot 73, a fourth slot 74, a fifth slot 75, a sixth slot 76, a seventh slot 77, and a eighth slot 78 arranged side by side. The first to eighth slots receive the first to eighth contact respectively. The horizontal portions 83 of the fourth and fifth contacts 214, 215 are longer than the other contacts' horizontal portions. The fourth and fifth slot 74, 75 are deeper than the other slots. Alternatively, the connecting portions 81 of the third and sixth contacts 213, 216 are arranged behind the connecting portions 81 of the fourth and fifth contacts 214, 215.

The connecting portion 81 includes a retention section 813 assembled into the corresponding holding slot 7, an insertion section 811 inserted in PCB 25, and a wire connecting section 812 disposed therebetween. The retention section 813 is wider than wire connecting section 812 along a left-to-right direction. The mating portion 85 includes a first inclined section 851 extending forwardly and upwardly from the horizontal portion 83, and a second inclined section 852 extending forwardly and downwardly from the first inclined section 851.

Figure 5:
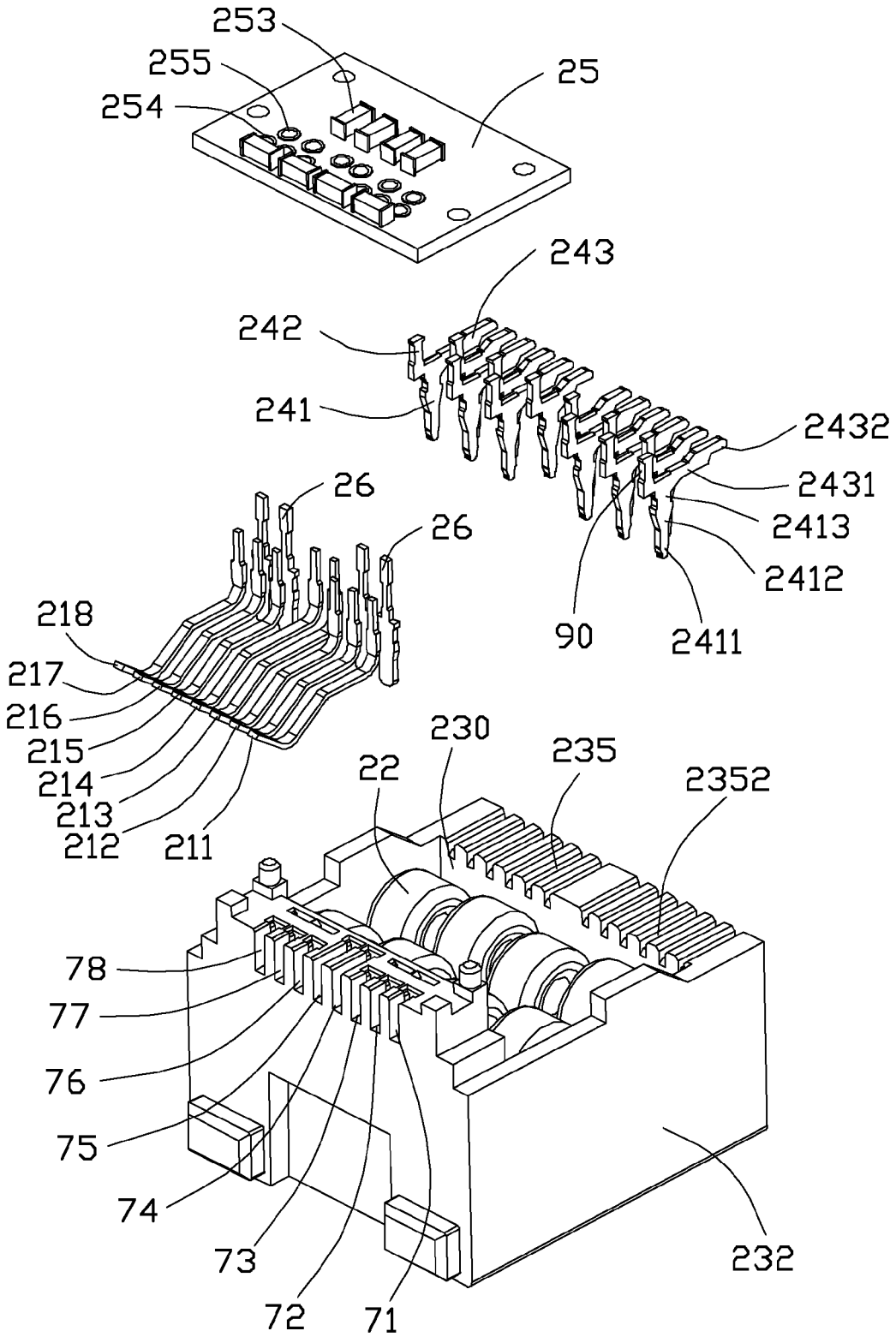
FIG. 5 is an exploded view of a contact module shown in FIG. 3.
Figure 6:
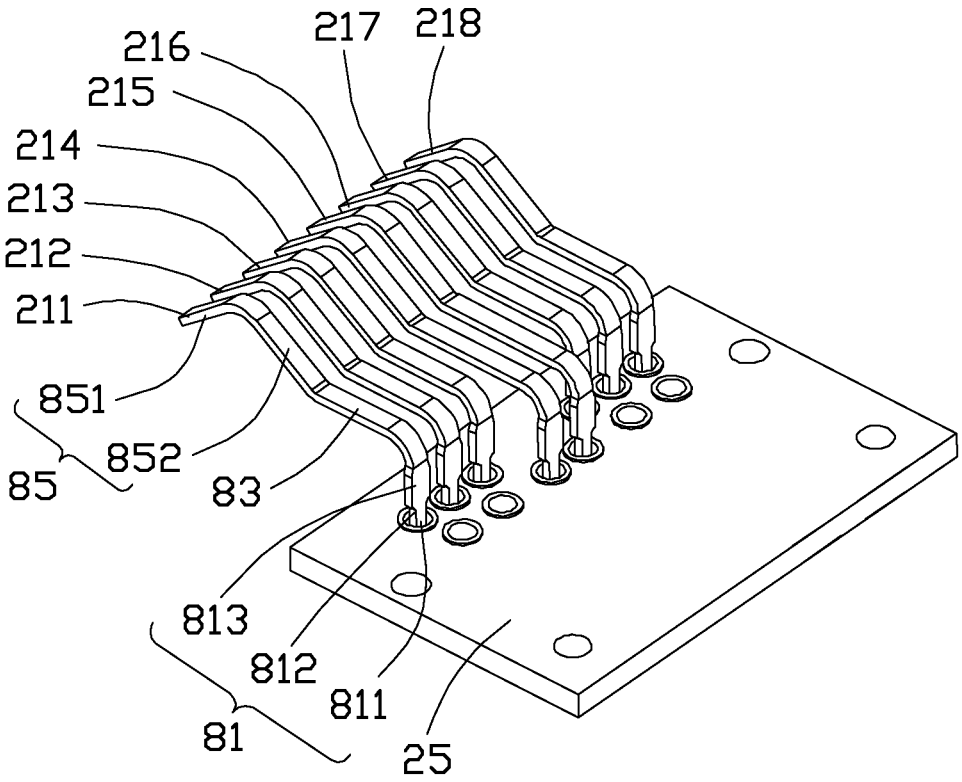
FIG. 6 is a perspective view of mating contacts mounted on a printed circuit board (PCB) shown in FIG. 5.
Figure 7:
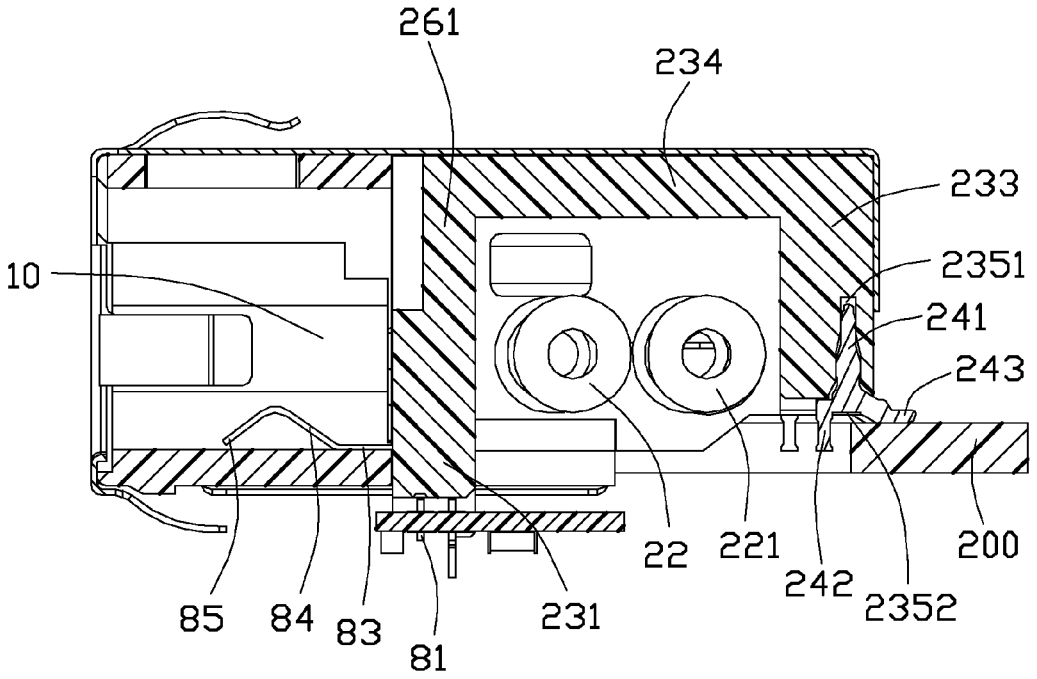
FIG. 7 is a cross-sectional view of the electrical connector, shown in FIG. 1.

Referring to FIGS. 5 and 7, each mounting contacts 24 includes a retention portion 241 held by the holding groove 235, a connecting portion 242 extending downwardly from a front section of the retention portion 241, and a mounting portion 243 extending backwardly from a back section of the retention portion 241. The mounting portions 243 extend backwardly beyond the rear wall 233 for surface mounting to the mother board 200. The holding groove 235 includes a vertical groove 2351 receiving the retention portion 813 and a horizontal groove 2352 receiving the mounting portion 243. The horizontal grooves 2352 extend through the rear wall 233 along the front-to-back direction for easily guiding the ends of the conductive wires. The retention portion 241 includes a top peak section 2411, a barb protrusion 2412 and a notch portion 2413. The barb protrusion 2412 is wider than the top peak section 24121 and the notch portion 2413. The mounting portion 243 includes a first horizontal section 2431 connecting with the retention portion 241 and a second horizontal section 2432 located below the first horizontal portion 2431.

The magnetic components 22 could include four isolated transformers and four common mode chokes. The contact module 2 also includes four center tap terminals 26 held to the front wall 231 of the inslulative carrier 23. The center tap terminals 26 connecting to center taps of the isolated transformer are aligned with the fourth and fifth contact 214, 215. Each magnetic component 22 has a magnetic toroidal core received in the receiving chamber 230 and a plurality of conductive wires (not shown) winding therearound. Each conductive wire includes a first end (not shown) connecting with one connecting portion 81 of the mating contacts 21 and an opposite second end (not shown) connecting with one connecting portion 242 of the mounting contacts. The mating contacts 21 are held by a bottom section of the front wall 231, and the mounting contacts 24 are held by a bottom section of the rear wall 233. The connecting portions of the mating contacts 21 and the mounting contacts 24 extend downwardly beyond the inslulative carrier 23. The electrical distance from the mating contacts to the mother board 200 is reduced so that noise and electromagnetic interference in the electrical connector also are reduced. 100271 The position of the first end connecting with the mating contact 21 and the position of the second end connecting with the mounting contact 24 could be aligned in a same level so that the electrical distance is greatly reduced. The connecting portion 242 of the mounting contact 24 has a notch 90 for the second end winding therearound.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing including a plug-receiving receptacle;

a set of mating contacts each having a mating portion extending in the plug-receiving receptacle, a first connecting portion extending along a top-to-bottom direction, and a horizontal portion connecting therebetween;

a set of mounting contacts each having a second connecting portion extending along the top-to-bottom direction and a mounting portion for mounting to a mother board;

an insulative carrier having integrally formed opposed front and rear walls and opposed side walls, said front, rear, and side walls defining a receiving chamber, the mating contacts held by a bottom section of the front wall, the mounting contacts held by a bottom section of the rear wall, the first and second connecting portions extending downwardly below the front and rear walls, respectively; and a set of magnetic components each having a magnetic core received in the receiving chamber and a plurality of conductive wires winding therearound, each conductive wire having a first end connecting with the first connecting portion of the mating contact and an opposite second end connecting with the second connecting portion of the mounting contacts.

2. The electrical connector as claimed in claim 1, wherein said front wall defines a set of holding slots located at a bottom section thereof, the first connecting portions inserted and retained into corresponding holding slots.

3. The electrical connector as claimed in claim 2, wherein said holding slots extend through a front face and a bottom face of the front wall.

4. The electrical connector as claimed in claim 1, wherein said rear wall defines a set of holding grooves located a bottom section thereof, the second connecting portions inserted and retained into corresponding holding grooves.

5. The electrical connector as claimed in claim 4, wherein said holding groove includes a horizontal groove extending through a front face, a rear face and a bottom face of the rear wall.

6. The electrical connector as claimed in claim 5, wherein said holding groove includes a vertical groove located above the horizontal groove, said mounting contact including a retention portion inserted and held in the vertical groove.

7. The electrical connector as claimed in claim 6, wherein said second connecting portion extends downwardly from a front section of the retention portion, and said mounting portion extends backwardly from a rear section of the retention portion for surface mounting to a mother board.

8. The electrical connector as claimed in claim 1, wherein said mating portion includes a first inclined section extending forwardly and upwardly from the horizontal portion, and a second inclined section extending forwardly and downwardly from the first inclined section.

9. The electrical connector as claimed in claim 1, further comprising a printed circuit board (PCB) disposed below the receiving chamber, the PCB defining a plurality of conductive holes.

10. The electrical connector as claimed in claim 9, wherein said first connecting portion includes a retention section assembled to the corresponding holding slot, an insertion section inserted in corresponding hole, and a wire connecting section disposed therebetween.

11. The electrical connector as claimed in claim 10, wherein said retention portion is wider than the wire connecting portion.

12. The electrical connector as claimed in claim 9, wherein said PCB has a plurality of capacitors mounted thereon, and each capacitor electrically connects between two mating contacts for compensating crosstalk therebetween.

13. The electrical connector as claimed in claim 1, wherein said magnetic components include four transformers and four common mode chokes.

14. The electrical connector as claimed in claim 1, wherein said magnetic core is a toroid core.

15. The electrical connector as claimed in claim 1, wherein said mating contacts include first, second, third, fourth, fifth, sixth, seventh, and eighth contacts arranged side by side, each pair of the first and second, the third and the sixth, the fourth and fifth, and the seventh and eighth contacts forming a differential signal pair, the connecting portions of the third and sixth contacts are arranged in a row, and the connecting portions of the fourth and fifth contacts are arranged in another row.

16. An electrical connector assembly comprising:

an insulative housing forming a mating cavity communicating forwardly with an exterior along a front-to-back direction;

a plurality of mating contacts disposed in the housing, each of said mating contacts including a front mating portion extending forwardly and upwardly into the mating cavity in a vertical direction perpendicular to said front-to-back direction, and a rear connecting portion extending downwardly;

an insulative carrier located behind the housing and defining a receiving chamber;

a small printed circuit board secured on a bottom face of the carrier, said connecting portions connected to a front region of said small printed circuit board, a plurality electronic components mounted upon the printed circuit board;

a plurality of mounting contacts secured to a rear side of the carrier; and a set of magnetic components essentially received within the receiving chamber, each of said magnetic component including a magnetic core and a plurality of conductive wires; wherein each of said wires includes a front end mechanically and electrically connected to the rear connecting portion of the corresponding contact, and a rear end mechanically and electrically connected to the corresponding mounting contact.

17. The electrical connector assembly as claimed in claim 16, wherein the connecting portion of each of said contacts is secured to a front side of the carrier.

18. The electrical connector assembly as claimed in claim 16, further including a large printed circuit board defining a notch in which a lower portion of the housing and the carrier are located; wherein the small printed circuit board is lower than the large printed circuit board.

19. The electrical connector assembly as claimed in claim 16, wherein the whole structure of each of said contacts is located below an upper surface of the large printed circuit board.

20. The electrical connector assembly as claimed in claim 16, wherein a front side of the carrier is lower than the rear side of the carrier.

* * * * *